US006413124B2

(12) United States Patent
Murakami et al.

(10) Patent No.: US 6,413,124 B2
(45) Date of Patent: Jul. 2, 2002

(54) CABLE-TERMINAL CONNECTING DEVICE FOR A BATTERY

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/829,986

(22) Filed: Apr. 11, 2001

(30) Foreign Application Priority Data

Apr. 12, 2000 (JP) ..... 2000-110888

(51) Int. Cl.[7] ..... H01R 4/50
(52) U.S. Cl. ..... 439/773
(58) Field of Search ..... 439/756, 726, 439/772, 733.1, 522, 773, 864, 770, 761

(56) References Cited

U.S. PATENT DOCUMENTS 5,269,709 A * 12/1993 Eriksson ..... 439/772

FOREIGN PATENT DOCUMENTS

JP 8-339851 12/1996

* cited by examiner

*Primary Examiner*—Brian Sircus
*Assistant Examiner*—Javaid Nasri

(57) ABSTRACT

A metal terminal (20) includes an post winding-around portion (23) which is connectable to an electrode post (2) to clasp from an outer side thereof. When a lock lever (25) is pressed down to a locking position, a clasp by the post winding-around portion (23) with respect to the electrode post (2) is set in a locked state. An insulating protective cover (30) is attachable to the metal terminal (20) so as to cover at least an entire connecting portion of the metal terminal (20), connected to the electrode post (2), when a distal end portion of the protective cover (30) is pressed down, while using as a fulcrum a proximal end portion of the protective cover (30) abutted against the post winding-around portion (23), and while causing the lock lever (25) to follow the protective cover (30) so that the lock lever (25) is pressed down to the locking position.

16 Claims, 3 Drawing Sheets

CABLE-TERMINAL CONNECTING DEVICE FOR A BATTERY

BACKGROUND OF THE INVENTION

1. Field of the Invention

The present invention relates to a cable-terminal connecting device which is connectable a terminal of an electric wire and/or a cable to an electrode post of positive or negative polarity, disposed on a power supply battery which is mounted in a vehicle (e.g., automobile).

The present application is based on Japanese Patent Application No. 2000-110888, which is incorporated herein by reference.

2. Description of the Related Art

As a related example of a cable-terminal connecting device, one disclosed in Unexamined Japanese Patent Publication No. Hei. 8-339851 has been known, and is schematically shown in FIGS. 4A and 4B.

Two electrode posts 2 (only one is shown in the drawing) of positive polarity and negative polarity, respectively, are provided uprightly on a battery body 1, and a cable 3 corresponding to each electrode post 2 of positive or negative polarity is connected to the electrode post 2 by a metal terminal 4 provided at an end of the cable 3. As is apparent from FIG. 4B, which is a plan view, the metal terminal 4 is secured to the cable 3 as a crimp portion 4*b* provided at the end of its terminal body 4*a* is crimped against a conductor 3*a* exposed by stripping an insulating coating at the cable end. A distal end portion of the terminal body 4*a* is formed as a post winding-around portion 4*c* which is formed circularly and returns in parallel, and this post winding-around portion 4*c* ia adapted to be wound around the electrode post 2. In addition, a pivot pin 5 is provided at parallel portions of the terminal body 4*a*. On one end side of the pivot pin 5, a lever 6 is pivotally supported at a longitudinal end thereof, while the other end of the lever 6 is pivotally supported by a box-shaped protective cover 8 by a pivot pin 7.

By virtue of the above-described structure, at the time of the cable connecting operation, the post winding-around portion 4*c* of the metal terminal 4 is lowered and fitted around the electrode post 2 in a wrapping manner. Subsequently, the protective cover 8 is rotated in the direction of arrow A, which is a clockwise direction, by pressing down a right end portion in FIG. 4A. In this operation of pressing down the cover, the lever 6 rotates about the axis of the pivot pin 5, and the terminal body 4*a* of the metal terminal 4 is subjected to compression in a direction in which the diameter of the post winding-around portion 4*c* is reduced, thereby tightly clasping the electrode post 2. Thus, the cable 3 is electrically connected to the electrode post 2 on the battery body 1.

With the device shown in FIGS. 4A and 4B, the following problems may be encountered.

First, in general, a typical metal terminal is secured to a cable end by crimping or the like as a single unit, so as to prepare for connection to an apparatus in an ensuing step, and is easy to handle in one aspect. However, in the case of the metal terminal 4 of the above-described structure, the box-shaped protective cover 8 is coupled to and integrated with it by the lever 6. For this reason, at the time of connection to the electrode post 2, the integrated structure on the complex metal terminal side is handled, so that the operation is extremely troublesome. Moreover, the number of component parts is large, including the metal terminal 4, the lever 6, the protective cover 8, and the pivot pins 5 and 7, so that there is a disadvantage in terms of cost.

Second, a situation can occur in which even after the protective cover 8 is pressed down starting from the state shown in FIG. 4A, and the cable is set in a state in which its connection to the post 2 has been completed, the lock still fails to function, and the protective cover springs up unexpectedly, causing the metal terminal 4 to come off the electrode post 2.

Furthermore, another problem is that the metal terminal 4 and the protective cover 8 are not directly coupled, and a pin hinge structure using the lever 6 on one side is adopted. Accordingly, the twisting or distortion of the protective cover 8 are liable to occur particularly with the pivot pin 7 as a fulcrum, and the locked state is unstable even after completion of the cable connection. For this reason, it is conceivable that the metal terminal 4 may become exposed, with the result that the protective cover 8 fails to perform its insulating function.

SUMMARY OF THE INVENTION

Accordingly, an object of the present invention is to provide a cable-terminal connecting device for a battery which enhances the operating and handling efficiency by reducing the number of component parts and adopting a simple structure, and which makes it possible to maintain required insulation performance by maintaining a stable locked state after connection to the cable.

To achieve the above object, according to a first aspect of the present invention, there is provided a cable-terminal connecting device for electrically connecting a cable to one of positive and negative polarity electrode posts of a battery. The cable-terminal connecting device comprises a metal terminal, to which a cable is connectable, including an post winding-around portion which is connectable to an electrode post to clasp from an outer side thereof, the electrode post being projected on a battery body; a lock lever attachable to the metal terminal, wherein when the lock lever is pressed down to a locking position, a clasp by the post winding-around portion with respect to the electrode post is set in a locked state; and an insulating protective cover attachable to the metal terminal so as to cover and accommodate at least an entire connecting portion of the metal terminal, connected to the electrode post, when a distal end portion of the protective cover is pressed down, while using as a fulcrum a proximal end portion of the protective cover abutted against the post winding-around portion, and while causing the lock lever to follow the protective cover so that the lock lever is pressed down to the locking position.

By virtue of the above-described construction in accordance with the first aspect, it is possible to separately form the metal terminal connected to an end portion of the cable and the protective cover for accommodating and protecting the metal terminal. Namely, since a member for coupling the two members is not needed, the number of component parts can be reduced accordingly, and handling during the operation is facilitated. Further, it is possible to overcome the deviating motion, such as shaking, of the protective cover during the pressing-down operation, which has been experienced with the example of the related art due to the fact that a coupling member is interposed. Meanwhile, in a state in which the post winding-around portion of the metal terminal is tentatively positioned after being lowered and fitted around the electrode post, when the protective cover is made to catch that post winding-around portion, and is operated by being pressed down by using the post winding-around portion as a fulcrum, the lock lever on the metal terminal side is pressed against the electrode post by following the movement. Hence, the three members, including the electrode post, the metal terminal, and the protective cover, are automatically locked as a unit. Namely, the connecting operation can be easily effected virtually with a single motion, and there is no chance of the protective cover lifting up or springing up after completion of the connection, which has been experienced with the structure of the related art. Accordingly, such the metal terminal as connected to the electrode post can be insulated and protected reliably.

According to a second aspect of the present invention, the device of the first aspect may further comprise a lock cam portion formed on a proximal end portion of the lock lever, wherein the lock cam portion has a cam surface which is pressed against the electrode post when the lock lever is located at the locking position. In this case, the lock lever is pivotally supported through a pivot pin at a root portion of the post winding-around portion so as to be pivotable in a pressing-down direction in an angular range of substantially 90 degrees from a substantially vertical position to the locking position which is a substantially horizontal position, while a distal end portion of the lock lever serves as a free end.

By virtue of the above-described construction in accordance with the second aspect, by merely effecting the pressing-down operation of the protective cover in the direction of being fitted over the metal terminal in the state of being tentatively positioned around the electrode post, the lock lever on the metal terminal side is set from the substantially vertical position to the locking position, in interlocking relation thereto. When the electrode post is pressed by the cam surface of the lock cam portion of the lock lever, moment based on the force of a lever and the force of cam action works, thereby making it possible to obtain a firmly locked state.

According to a third aspect of the present invention, the device according to any one of the first and second aspects may further comprise at least one terminal-locking pawl portion formed on a proximal edge of the protective cover, wherein the terminal-locking pawl portion serves as the fulcrum when the distal end portion of the protective cover is pressed down while the terminal-locking pawl portion is abutted against an edge of the post winding-around portion.

According to a fourth aspect of the present invention, the device according to any one of the first aspect to the third aspect may further comprise a lever-operating cap portion pivotably disposed on a cover body of the protective cover, the lever-operating cap portion being operative, while pivoting together with the lock lever, to open and close a cap-accommodating elongated hole, which is formed in an upper surface of the cover body, and through which a part of the lock lever is passable.

According to a fifth aspect of the present invention, the device according to any one of the first aspect to the fourth aspect may further comprise at least one cap locking projection projected on an outer wall surface at a distal end of the lever-operating cap portion; and at least one cap locking recess engageable with the cap locking projection, the cap locking recess being formed in a distal end portion of the cover body. In this case, the lever-operating cap portion is set in a locked state with respect to the cover body when the cap locking projection is engaged with the cap locking recess.

By virtue of the above-described construction in accordance with respective one of the third aspect to the fifth aspect, the following advantageous effects are presently considerable. As for the protective cover, by making effective use of plastic molding, the lever-operating cap portion can be molded integrally with the cover body so as to be capable of being raised or laid down freely. Further, since it suffices if the cap locking projection and the cap locking recess are merely molded to allow the cover body and the lever-operating cap portion to be fitted with each other, insulation and protection of the metal terminal after connection can be effected easily and reliably without using a special mechanical part for fitting or locking, and the overall structure becomes very simple.

According to a sixth aspect of the present invention, the device according to any one of the first aspect to the fifth aspect may further comprise a lever locking projection formed on an inner surface of a side wall of the lever-operating cap portion or the cover body of the protective cover. In this case, the lever locking projection is abutted against the lock lever from therebelow to retain the lock lever.

By virtue of the above-described construction in accordance with the sixth aspect, if the lever locking projection is integrally formed on the inner side of the cover body of the protective cover, the lock lever on the metal terminal side can be locked by this lever locking projection.

DETAILED DESCRIPTION OF THE PREFERRED EMBODIMENT

A preferred embodiment of the present invention now will be described in detail hereinbelow with reference to the accompanying drawings.

Figure 1:
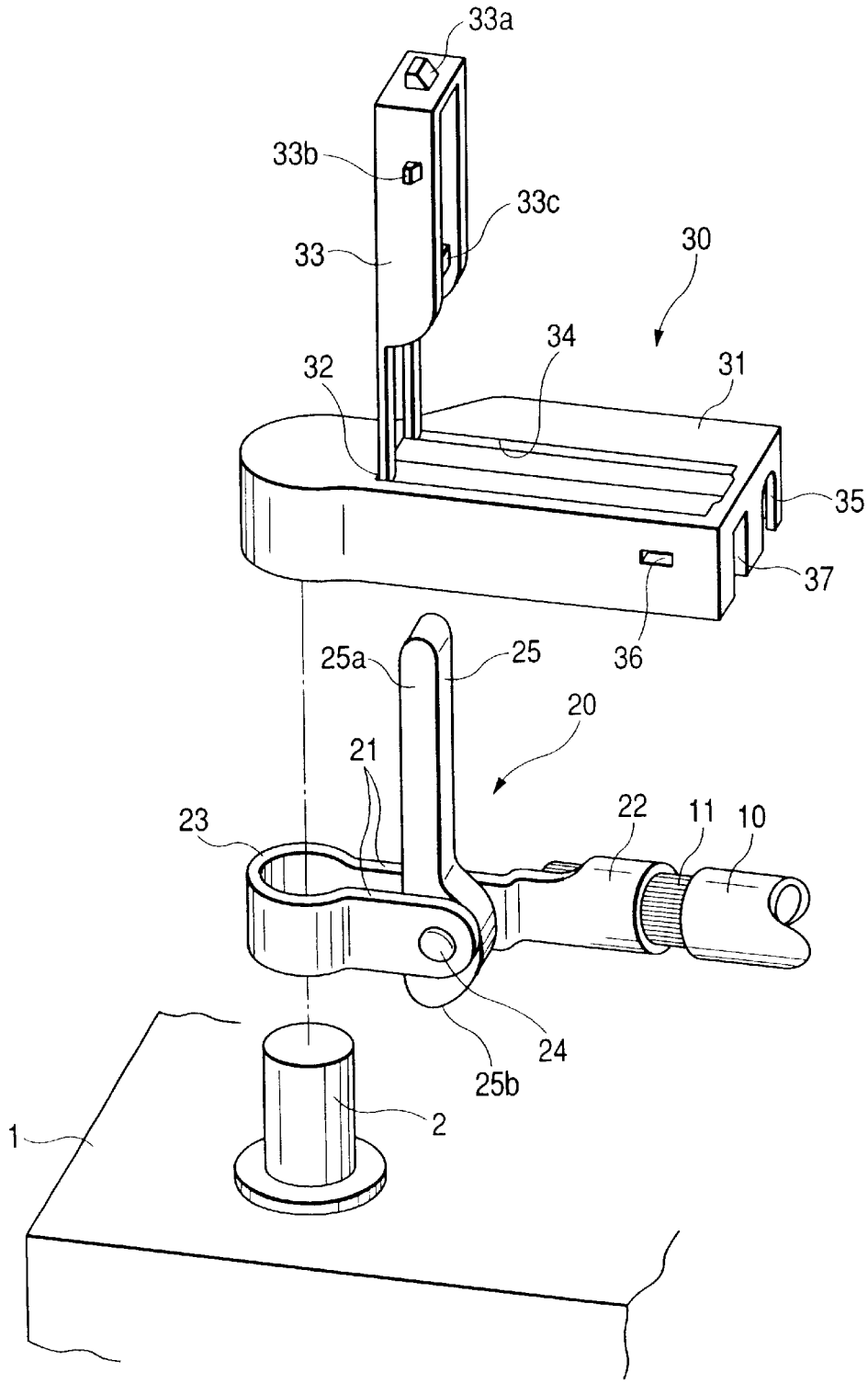
FIG. 1 is an exploded perspective view illustrating a cable-terminal connecting device for a battery in accordance with an embodiment of the present invention.
Figure 2:
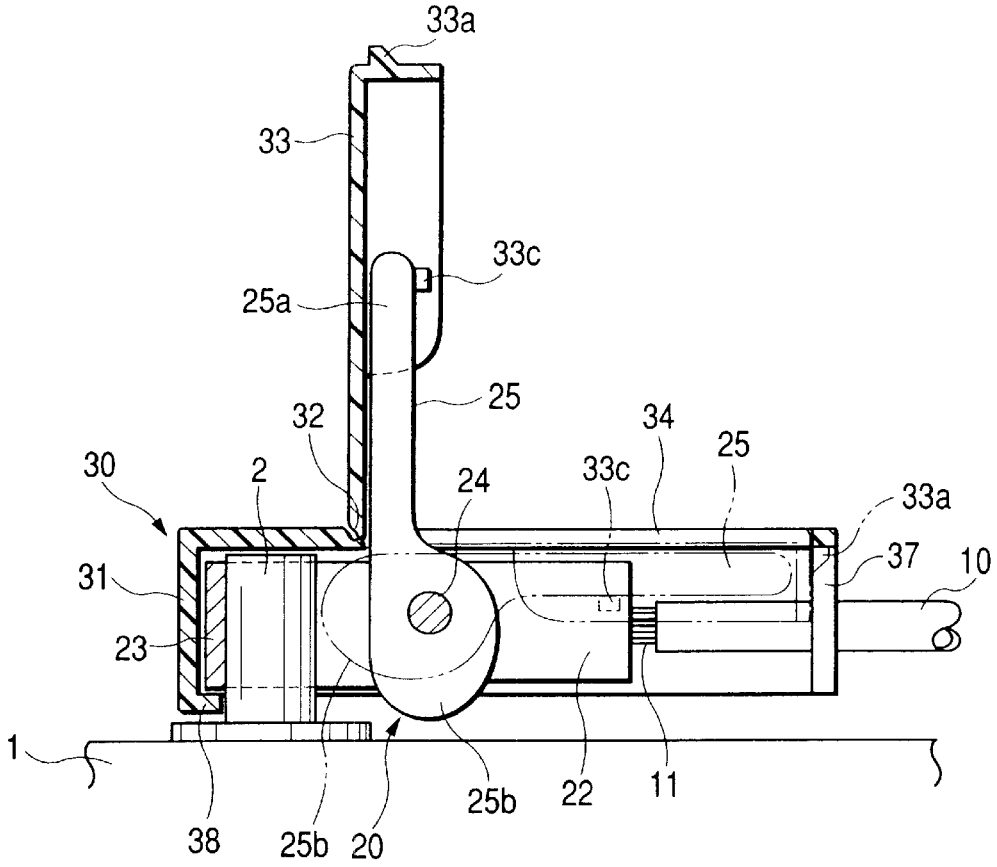
FIG. 2 is a side cross-sectional view illustrating a stage before a protective cover, after being placed on a metal terminal in a state of being tentatively positioned on an electrode post on a battery body, is set in a locked state, and FIG. 2 also shows a substantially horizontally locked state of a lock lever, which is shown by two-dot chain lines in the drawing, as a side elevational view taken along line II—II in the direction of arrows in FIG. 3.
Figure 3:
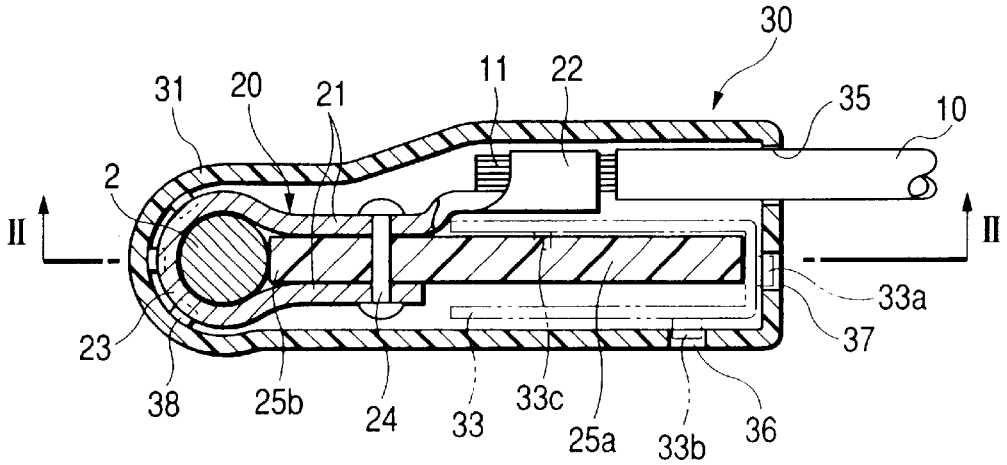
FIG. 3 is a plan cross-sectional view illustrating a form in which the metal terminal is finally tightened to the electrode post by the lock lever and is connected thereto.

FIGS. 1 to 3 show a cable-terminal connecting device of the preferred embodiment. Two electrode posts 2 (only one is shown in the drawings), which are power fetching terminals respectively used as a positive electrode (+) and a negative electrode (−), are provided on an upper surface cover portion of a battery body 1 so as to rise substantially vertically.

A corresponding cable 10 is connected to each electrode post 2 for the positive or negative electrode by a metal terminal 20 secured to an end portion of the cable 10. An insulator at the end portion of the cable 10 is stripped off, and a conductor 11 is exposed. A crimp portion 22 provided at a proximal end of a terminal body 21 of the metal terminal 20 is secured to this conductor 11 by way of clamping or the like.

The terminal body 21 of the metal terminal 20 has a bent shape in which an annular post winding-around portion 23 is formed at its forward end, and its tip portion returns therefrom in parallel. The post winding-around portion 23 has an inside diameter sufficient to allow the post winding-around portion 23 to be wound around the electrode post 2 by being lowered from above in the drawing. An elongated lock lever 25 at its proximal end portion is pivotally supported via a pivot pin 24 by the terminal body 21 which forms root portions of the post winding-around portion 23. The proximal end portion of the lever 25 is formed as a lock cam portion 25*b* jutting out from the width of a lever body 25*a*, and its outer surface is formed in a curved shape eccentric with the center axis of the pivot pin 24 as a cam surface.

Meanwhile, an insulating protective cover 30 is provided which has such a size and a shape as to be capable of accommodating both the metal terminal 20 and an end portion of the cable 10.

As is apparent from FIG. 1, this protective cover 30 is a resin molded piece, and has an elongated box shape in which an upper surface of a cover body 31 is closed. A lever operating cap portion 33, the formation of which is possible by resin molding, is formed as a cutout in the upper surface of the cover body 31, and is connected at its longitudinal proximal end to the upper surface of the cover body 31 by a thin-walled hinge portion 32 in such a manner as to be capable of being raised upright. In the upper surface of the cover body 31 after the lever operating cap portion 33 is raised, a cap-accommodating elongated hole 34 extending in its longitudinal direction is formed. Accordingly, if the lever operating cap portion 33 is returned to its original position in a substantially horizontal direction and is set in the form of burying the cap-accommodating elongated hole 34, the lever operating cap portion 33 becomes flush with the plane of the upper surface of the cover body 31, so that the upper surface of the cover body 31 becomes flat.

Further, a proximal end portion of the cover body 31 is formed in a dome shape having a circular space capable of accommodating the electrode post 2 and the post winding-around portion 23 of the metal terminal 20. In the embodiment, a plurality of terminal-locking pawl portions 38 are formed at a lower edge of the dome in such a manner as to project inwardly. The terminal-locking pawl portions 38 are adapted to be capable of catching and engaging a lower edge of the post winding-around portion 23 provided in the metal terminal 20. However, there may be formed at least one of the terminal-locking pawl portions 38.

In addition, as shown in FIG. 1, the lever-operating cap portion 33 is formed in a box shape having a U-shaped cross section and extending from its distal end halfway in a direction toward its proximal end. A cap locking projection 33*a* is provided projectingly on an outer surface of a front wall at the distal end portion of the lever-operating cap portion 33. In a state in which the upper surface of the cover body 31 is flush and flat, the cap locking projection 33*a* engages a cap locking recess 37 provided in a front wall at a distal end of the elongated box-shaped cover body 31, thereby allowing the lever-operating cap portion 33 to be set in a locked state flush with the cover body 31. Further, a cap locking projection 33*b* is also provided projectingly on an outer surface of a side wall of the distal end portion of the lever-operating cap portion 33, and is adapted to engage a cap locking recess 36 provided in a side wall of a distal end portion of the cover body 31, thereby similarly setting the lever-operating cap portion 33 in the locked state.

However, there may be formed at least one of the cap locking projections 33*a*, 33*b*. However, there may be formed at least one of the cap locking recesses 36, 37.

In addition, a lever locking projection 33*c* is provided projectingly on an inner surface of a side wall of the distal end portion of the lever-operating cap portion 33. The arrangement provided is such that the lever body 25*a* of the lock lever 25 can be locked in a state of being tucked and held inside the lever-operating cap portion 33, as will be described later.

Further, a cable inserting port 35 is provided in the front wall of the distal end portion the cover body 31 in such a manner as to be juxtaposed with the aforementioned cap locking recess 37. The cable 10 is passed through this cable inserting port 35 such that the metal terminal 20 can be accommodated inside the protective cover 30.

Next, with respect to the cable-terminal connecting device having the above-described construction in accordance with this embodiment, a description will be given of a form of assembly in which the cable 10 is electrically connected to the electrode post 2 on the battery body 1, as well as its operation.

First, as shown in FIG. 1, at the time of performing the operation of connection to the electrode post 2, the metal terminal 20 is prepared in a state in which its crimp portion 22 is secured in advance to the conductor 11 at the end of the cable 10. At that juncture, the lock lever 25 of the metal terminal 20 is set in the state of being raised substantially perpendicular to the terminal body 21. The metal terminal 20 in this state is tentatively positioned such that the post winding-around portion 23 of its tip portion is lowered and fitted over the electrode post 2 on the battery body 1 in a wrapping manner.

Subsequently, in the protective cover 30, the lever-operating cap portion 33 is pulled upward from the upper surface of the cover body 31 and is set in a substantially vertical position. In this state, the terminal-locking pawl portions 38 at the lower edge of the dome of the proximal end portion of the cover body 31 of the protective cover 30 are made to catch and engage the lower edge of the post winding-around portion 23 of the metal terminal 20 in the tentatively positioned state. By using the terminal-locking pawl portions 38 as a fulcrum of rotation, the overall protective cover 30 is rotatively operated by being pressed and turned clockwise in the drawing.

If the protective cover 30 is operated by being pressed and turned, the lock lever 25 on the metal terminal 20 side is pulled down in the same direction by following its movement, and the lock cam portion 25*b* at the proximal end portion is pressed against the electrode post 2 at its outer peripheral cam surface by using the pivot pin 24 as the center of rotation. As the protective cover 30 is pulled down, the cable inserting port 35 at the front end of the cover body 31 is fitted over a vicinity of an end portion of the cable 10 from above, and the end portion of the cable 10 is accommodated in the cover body 31 in such a manner as to be enclosed therein.

Figure 4A:
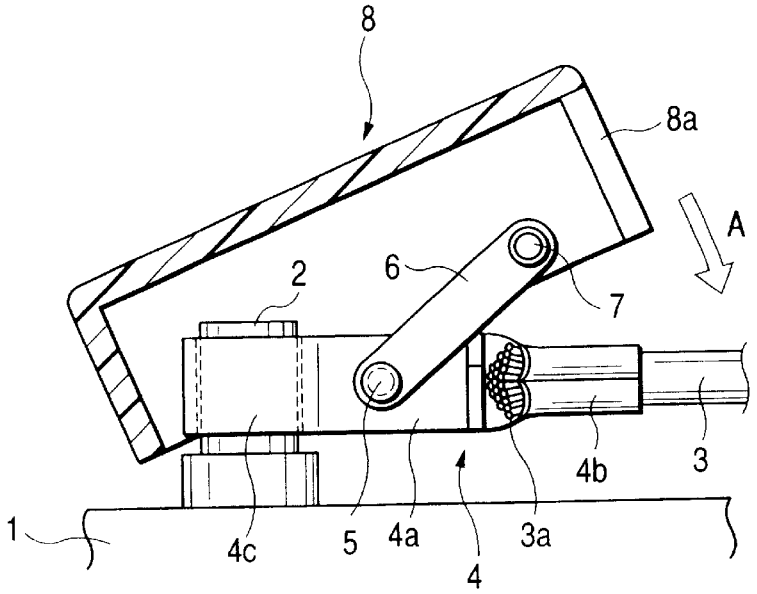
FIG. 4A PRIOR ART
FIGS. 4A and 4B are a side elevational view and a plan view, both partly in section, illustrating a form prior to the completion of connection in a related device.
Figure 4B:
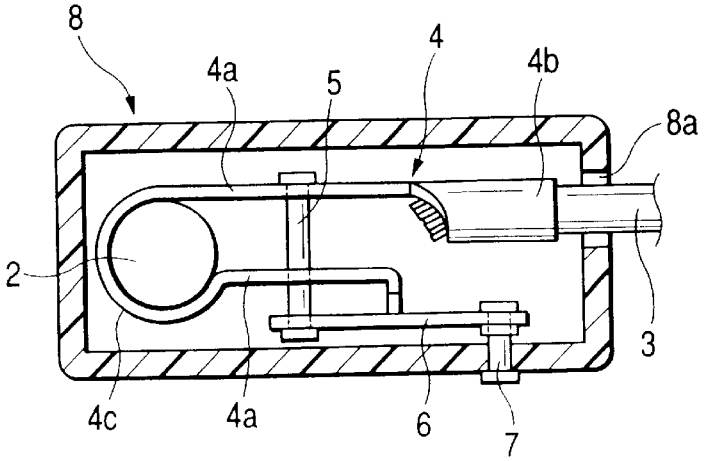
FIG. 4B PRIOR ART

Meanwhile, in the operation of pressing down the protective cover 30, a coupling member such as the lever 6 shown in FIGS. 4A and 4B illustrating the related example is not interposed between the protective cover 30 and the metal terminal 20. For this reason, the cover body 31 is free from undergoing a deviating motion caused by shaking or unstable movement during the pressing-down operation, and the cover body 31 can be operated with a stable attitude.

In addition, while the lock cam portion 25*b* is being pressed against the electrode post 2, the terminal-locking pawl portions 38 on the protective cover 30 side abut against the lower edge of the post winding-around portion 23 on the metal terminal 20 side in a biting manner. Therefore, it is possible to increase the force with which the cam surface of the lock cam portion 25*b* presses against the electrode post 2 by using this abutting portion as a fulcrum of a lever. Namely, when the force with which the cover body 31 of the protective cover 30 is pressed down acts on the lever body 25*a* of the lock lever 25 as a point of effort, due to leverage the support pin 24 functions as a fulcrum of a lever, while the cam surface of the lock cam portion 25*b* and the terminal-locking pawl portions 38 biting at the lower edge of the post winding-around portion 23 function as points of application, respectively.

When the lock lever 25 is pressed down substantially horizontally, the locking of the lock cam portion 25*b* with respect to the electrode post 2 is completed, and the metal terminal 20 is firmly connected to the electrode post 2. At the same time, on the protective cover 30 side, the lever-operating cap portion 33 is fitted in the cap-accommodating elongated hole 34 in the upper surface of the cover body 31 and becomes flush therewith. Consequently, the cap locking projections 33*a* and 33*b* on the lever-operating cap portion 33 side are fitted in the respective cap locking recesses 36 and 37 on the cover body 31 side.

The lever-operating cap portion 33 and the lock lever 25 during the pressing-down operation are positionally offset relative to each other in synchronism with the aforementioned fitting between the projections and recesses. In the meantime, until the lever-operating cap portion 33 reaches a substantially locked position (see FIG. 3), the lever locking projection 33*c* on the lever-operating cap portion 33 side holds the lever body 25*a* of the lock lever 25 by abutting against the lever body 25*a* from below.

In the above-described series of movement, as the lock lever 25 on the metal terminal 20 side is rotated to a locking position substantially integrally with the pressing-down operation of the protective cover 30, it is possible to reliably effect the firm coupling of the metal terminal 20 with the electrode post 2 as well as the insulation and protection of the overall cable terminal connecting portion by the coupling, and the operation in the meantime is simple and efficient.

As described above, since the metal terminal secured to the end portion of the cable and the protective cover for accommodating and protecting it are formed as separate members, and a member for coupling the two members is not provided, the number of component parts can be reduced accordingly. In addition, in a state in which the post winding-around portion of the metal terminal is tentatively positioned after being lowered and fitted around the electrode post, when the protective cover is made to catch that post winding-around portion and is operated by being pressed down by using the post winding-around portion as a fulcrum of a lever, the lock lever on the metal terminal side is pressed against the electrode post by following that movement. Hence, the three members, including the electrode post, the metal terminal, and the protective cover, are automatically locked as a unit. Namely, the connecting operation can be easily effected virtually with a single motion, and there is no risk of the protective cover lifting up or springing up after completion of the connection, which has been experienced with the structure of the related art. Thus the metal terminal as connected to the electrode post can be insulated and protected reliably.

In addition, by merely effecting the pressing-down operation of the protective cover in the direction of being fitted over the metal terminal in the state of being tentatively positioned around the electrode post, the lock lever on the metal terminal side is set from the substantially vertical position to the locking position, i.e., the substantially horizontal position, in interlocking relation thereto. When the electrode post is pressed by the cam surface of the lock cam portion of the lock lever, moment based on the force of a lever and the force of cam action works, thereby making it possible to obtain a firmly locked state.

In addition, by making effective use of plastic molding, the lever-operating cap portion can be molded integrally with the cover body so as to be capable of being raised or laid down freely. Further, since it suffices if the cap locking projection and the cap locking recess are merely molded to allow the cover body and the lever-operating cap portion to be fitted with each other, insulation and protection of the metal terminal after connection can be effected easily and reliably without using a special mechanical part for fitting or locking, and the overall structure becomes very simple.

In addition, if the lever locking projection is integrally formed on the inner side of the cover body of the protective cover, at the same time as the lock lever on the metal terminal side is pressed down in interlocking relation to the pressing-down operation of the cover body, the lock lever can be locked by that lever locking projection. Hence, it is possible to realize a one-touch operation facilitating the connecting and assembling operation.

What is claimed is:

1. A cable-terminal connecting device for electrically connecting a cable to one of positive and negative polarity electrode posts of a battery, the device comprising:

a metal terminal, to which a cable is connectable, including an post winding-around portion which is connectable to an electrode post to clasp from an outer side thereof, the electrode post being projected on a battery body;

a lock lever attachable to the metal terminal, wherein when the lock lever is pressed down to a locking position, a clasp by the post winding-around portion with respect to the electrode post is set in a locked state; and an insulating protective cover attachable to the metal terminal so as to cover and accommodate at least an entire connecting portion of the metal terminal, connected to the electrode post, when a distal end portion of the protective cover is pressed down, while using as a fulcrum a proximal end portion of the protective cover abutted against the post winding-around portion, and while causing the lock lever to follow the protective cover so that the lock lever is pressed down to the locking position.

2. The device of claim 1, further comprising a lock cam portion formed on a proximal end portion of the lock lever, the lock cam portion having a cam surface which is pressed against the electrode post when the lock lever is located at the locking position, wherein the lock lever is pivotally supported through a pivot pin at a root portion of the post winding-around portion so as to be pivotable in a pressing-down direction in an angular range of substantially 90 degrees from a substantially vertical position to the locking position which is a substantially horizontal position, while a distal end portion of the lock lever serves as a free end.

3. The device of claim 1, further comprising at least one terminal-locking pawl portion formed on a proximal edge of the protective cover, wherein the terminal-locking pawl portion serves as the fulcrum when the distal end portion of the protective cover is pressed down while the terminal-locking pawl portion is abutted against an edge of the post winding-around portion.

4. The device of claim 2, further comprising at least one terminal-locking pawl portion formed on a proximal edge of the protective cover, wherein the terminal-locking pawl portion serves as the fulcrum when the distal end portion of the protective cover is pressed down while the terminal-locking pawl portion is abutted against an edge of the post winding-around portion.

5. The device of claim 1, further comprising a lever-operating cap portion pivotably disposed on a cover body of the protective cover, the lever-operating cap portion being operative, while pivoting together with the lock lever, to open and close a cap-accommodating elongated hole, which is formed in an upper surface of the cover body, and through which a part of the lock lever is passable.

6. The device of claim 2, further comprising a lever-operating cap portion pivotably disposed on a cover body of the protective cover, the lever-operating cap portion being operative, while pivoting together with the lock lever, to open and close a cap-accommodating elongated hole, which is formed in an upper surface of the cover body, and through which a part of the lock lever is passable.

7. The device of claim 3, further comprising a lever-operating cap portion pivotably disposed on a cover body of the protective cover, the lever-operating cap portion being operative, while pivoting together with the lock lever, to open and close a cap-accommodating elongated hole, which is formed in an upper surface of the cover body, and through which a part of the lock lever is passable.

8. The device of claim 4, further comprising a lever-operating cap portion pivotably disposed on a cover body of the protective cover, the lever-operating cap portion being operative, while pivoting together with the lock lever, to open and close a cap-accommodating elongated hole, which is formed in an upper surface of the cover body, and through which a part of the lock lever is passable.

9. The device of claim 5, further comprising:

at least one cap locking projection projected on an outer wall surface at a distal end of the lever-operating cap portion; and at least one cap locking recess engageable with the cap locking projection, the cap locking recess being formed in a distal end portion of the cover body, wherein the lever-operating cap portion is set in a locked state with respect to the cover body when the cap locking projection is engaged with the cap locking recess.

10. The device of claim 6, further comprising:

at least one cap locking projection projected on an outer wall surface at a distal end of the lever-operating cap portion; and at least one cap locking recess engageable with the cap locking projection, the cap locking recess being formed in a distal end portion of the cover body, wherein the lever-operating cap portion is set in a locked state with respect to the cover body when the cap locking projection is engaged with the cap locking recess.

11. The device of claim 7, further comprising:

at least one cap locking projection projected on an outer wall surface at a distal end of the lever-operating cap portion; and at least one cap locking recess engageable with the cap locking projection, the cap locking recess being formed in a distal end portion of the cover body, wherein the lever-operating cap portion is set in a locked state with respect to the cover body when the cap locking projection is engaged with the cap locking recess.

12. The device of claim 8, further comprising:

at least one cap locking projection projected on an outer wall surface at a distal end of the lever-operating cap portion; and at least one cap locking recess engageable with the cap locking projection, the cap locking recess being formed in a distal end portion of the cover body, wherein the lever-operating cap portion is set in a locked state with respect to the cover body when the cap locking projection is engaged with the cap locking recess.

13. The device of claim 1, further comprising a lever locking projection formed on an inner surface of a side wall of a cover body of the protective cover, the lever locking projection being abutted against the lock lever from therebelow to retain the lock lever.

14. The device of claim 5, further comprising a lever locking projection formed on an inner surface of a side wall of the lever-operating cap portion, the lever locking projection being abutted against the lock lever from therebelow to retain the lock lever.

15. The device of claim 9, further comprising a lever locking projection formed on an inner surface of a side wall of the lever-operating cap portion, the lever locking projection being abutted against the lock lever from therebelow to retain the lock lever.

16. The device of claim 1, wherein the protective cover has an elongated box shape capable of covering the metal terminal.

* * * * *